US011196224B2

(12) United States Patent
Liao

(10) Patent No.: US 11,196,224 B2
(45) Date of Patent: Dec. 7, 2021

(54) BOARD-TO-BOARD CONNECTOR WITH ALIGNMENT FEATURES

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventor: Fang-Jwu Liao, New Taipei (TW)

(73) Assignees: FUDING PRECISION COMPONENTS (SHENZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/740,513

(22) Filed: Jan. 13, 2020

(65) Prior Publication Data

US 2020/0235539 A1 Jul. 23, 2020

(30) Foreign Application Priority Data

Jan. 18, 2019 (CN) ..... 201920093157.1

(51) Int. Cl.
*H01R 33/20* (2006.01)
*H01R 13/629* (2006.01)
(Continued)

(52) U.S. Cl.
CPC ..... *H01R 33/20* (2013.01); *H01R 12/737* (2013.01); *H01R 12/91* (2013.01); *H01R 13/629* (2013.01);
(Continued)

(58) Field of Classification Search
CPC .... H01R 12/52; H01R 13/64; H01R 12/7005; H01R 12/57; H01R 12/714; H01R 12/721;
(Continued)

(56) References Cited

U.S. PATENT DOCUMENTS 7,182,650 B2 * 2/2007 Liao ..... H05K 7/1007 439/680
2004/0166704 A1 * 8/2004 Perugini ..... H01R 13/6591 439/74
(Continued)

FOREIGN PATENT DOCUMENTS

CN 104979717 B 11/2017

*Primary Examiner* — Abdullah A Riyami
*Assistant Examiner* — Justin M Kratt
(74) *Attorney, Agent, or Firm* — Ming Chieh Chang; Wei Te Chung

(57) ABSTRACT

An electrical connector assembly includes a male/plug/first connector and a female/receptacle/second connector mateable with each other. The first connector includes a first plate and a plurality of first contacts retained to the first plate, and the second connector includes a second plate and a plurality of second contacts retained to the second plate. The first plate includes opposite first long side and second long side to respectively form a first alignment structure and a second alignment structure which is offset from the first alignment structure in the longitudinal direction. The second plate includes opposite third long and fourth long side to respectively form a third alignment structure and a fourth alignment structure to be coupled to the corresponding first alignment structure and second alignment structure during mating.

7 Claims, 8 Drawing Sheets

(51) Int. Cl.

| | |
|---|---|
| ***H01R 12/73*** | (2011.01) |
| ***H01R 24/54*** | (2011.01) |
| ***H01R 12/91*** | (2011.01) |
| *H01R 12/70* | (2011.01) |
| *H01R 12/59* | (2011.01) |
| *H01R 13/11* | (2006.01) |
| *H01R 13/641* | (2006.01) |
| *H01R 12/71* | (2011.01) |
| *H01R 12/72* | (2011.01) |
| *H01R 12/61* | (2011.01) |
| *H01R 12/62* | (2011.01) |
| *H01R 12/79* | (2011.01) |
| *H01R 13/645* | (2006.01) |
| *H01R 12/52* | (2011.01) |
| *H01R 12/78* | (2011.01) |
| *H01R 107/00* | (2006.01) |
| *H01R 13/627* | (2006.01) |

(52) U.S. Cl.
CPC ..... *H01R 24/542* (2013.01); *H01R 12/523* (2013.01); *H01R 12/59* (2013.01); *H01R 12/61* (2013.01); *H01R 12/62* (2013.01); *H01R 12/707* (2013.01); *H01R 12/7082* (2013.01); *H01R 12/71* (2013.01); *H01R 12/712* (2013.01); *H01R 12/716* (2013.01); *H01R 12/721* (2013.01); *H01R 12/73* (2013.01); *H01R 12/732* (2013.01); *H01R 12/78* (2013.01); *H01R 12/79* (2013.01); *H01R 13/112* (2013.01); *H01R 13/6276* (2013.01); *H01R 13/641* (2013.01); *H01R 13/6456* (2013.01); *H01R 2107/00* (2013.01)

(58) Field of Classification Search
CPC H01R 2107/00; H01R 12/73; H01R 12/7082; H01R 12/79; H01R 12/523; H01R 12/712; H01R 13/641; H01R 12/62; H01R 12/78; H01R 12/71; H01R 12/59; H01R 12/61; H01R 13/6276; H01R 33/20; H01R 13/629; H01R 12/737; H01R 24/542; H01R 12/91; H01R 13/6456; H01R 13/112; H01R 12/732; H01R 12/716; H01R 12/707
USPC ..... 439/74, 633, 680, 378
See application file for complete search history.

(56) References Cited

U.S. PATENT DOCUMENTS

2015/0288100 A1* 10/2015 Liao ..... H01R 12/523 439/74
2019/0267734 A1* 8/2019 Tamai ..... H01R 12/721

* cited by examiner

BOARD-TO-BOARD CONNECTOR WITH ALIGNMENT FEATURES

BACKGROUND OF THE DISCLOSURE

1. Field of the Disclosure

The present disclosure relates to an electrical connector assembly, and particularly to a male connector and a female connector mateable with each other and equipped with thereof the corresponding alignment mechanism which not only guarantees the correct orientation therebetween but also essentially symmetric along the longitudinal direction of the connector assembly so as not to jeopardize the structural strength due to the asymmetrical arrangement of the molding structure of the housing in the longitudinal direction.

2. Description of Related Arts

The board-to-board connector assembly essentially includes a male connector mounted upon a first printed circuit board, and a female connector mounted upon a second printed circuit board adapted to be mated with the male connector. Anyhow, because of the rectangular configuration of the mated connectors, it is relatively easy to have the male connector and the female connector mated with each other in a wrong orientation, i.e., the 180 degrees difference. To prevent such a mis-mating, a chamfered structure or a key structure may be provided on one of the male connector and the female connector so as to assure only the correct one orientation can be performed during mating. Anyhow, such a one sided orientation structure is essentially in an offset arrangement with regard to the transverse centerline in the longitudinal direction, thus affecting the ideal symmetrical arrangement of the housing of the connector.

An improved connector assembly is desired to provide the anti-mis-mating structure which is essentially symmetrical along the longitudinal direction of the connector housing.

SUMMARY OF THE DISCLOSURE

An object of the invention is to provide an electrical connector assembly with a male/plug/first connector and a female/receptacle/second connector mateable with each other. The first connector includes a first plate and a plurality of first contacts retained to the first plate, and the second connector includes a second plate and a plurality of second contacts retained to the second plate. The first plate includes opposite first long side and second long side to respectively form a first alignment structure and a second alignment structure which is offset from the first alignment structure in the longitudinal direction. The second plate includes opposite third long and fourth long sides to respectively form a third alignment structure and a fourth alignment structure to be coupled to the corresponding first alignment structure and second alignment structure during mating.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
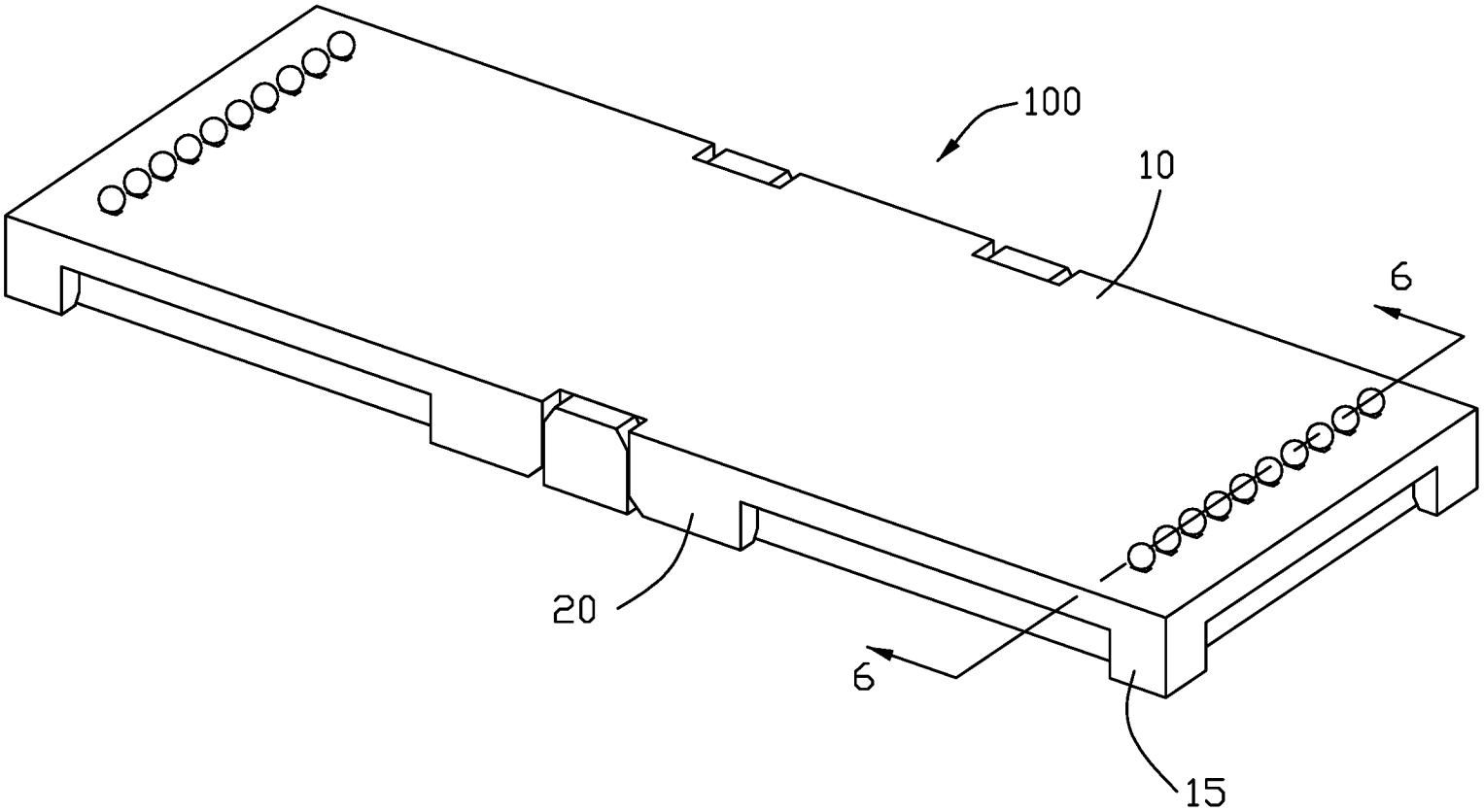
FIG. 1 is a perspective view of an electrical connector assembly of the invention, including the mated electrical male connector and female connector.
Figure 2:
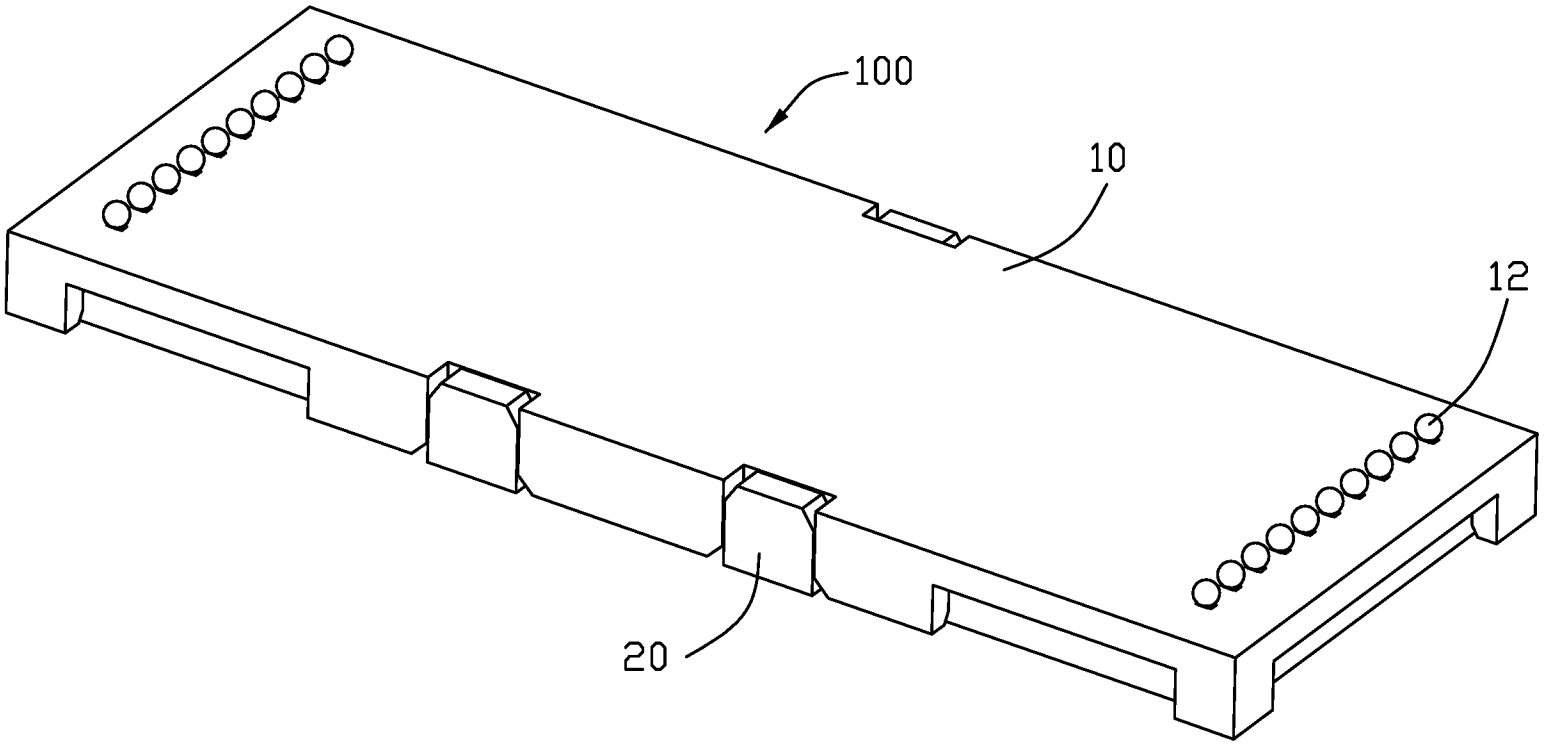
FIG. 2 is another perspective view of the electrical connector assembly of FIG. 1.
Figure 3:
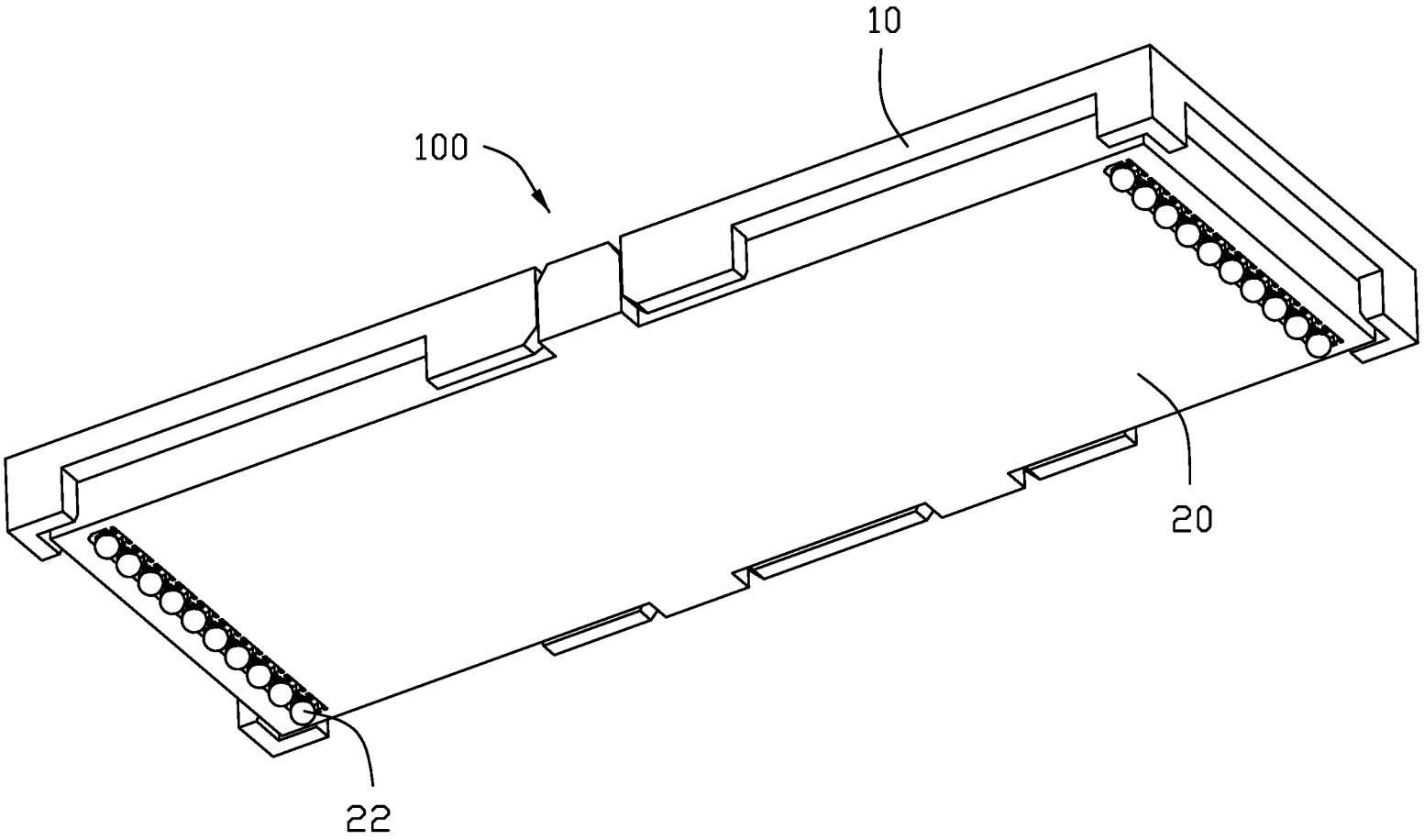
FIG. 3 is another perspective view of the electrical connector assembly of FIG. 1.
Figure 4:
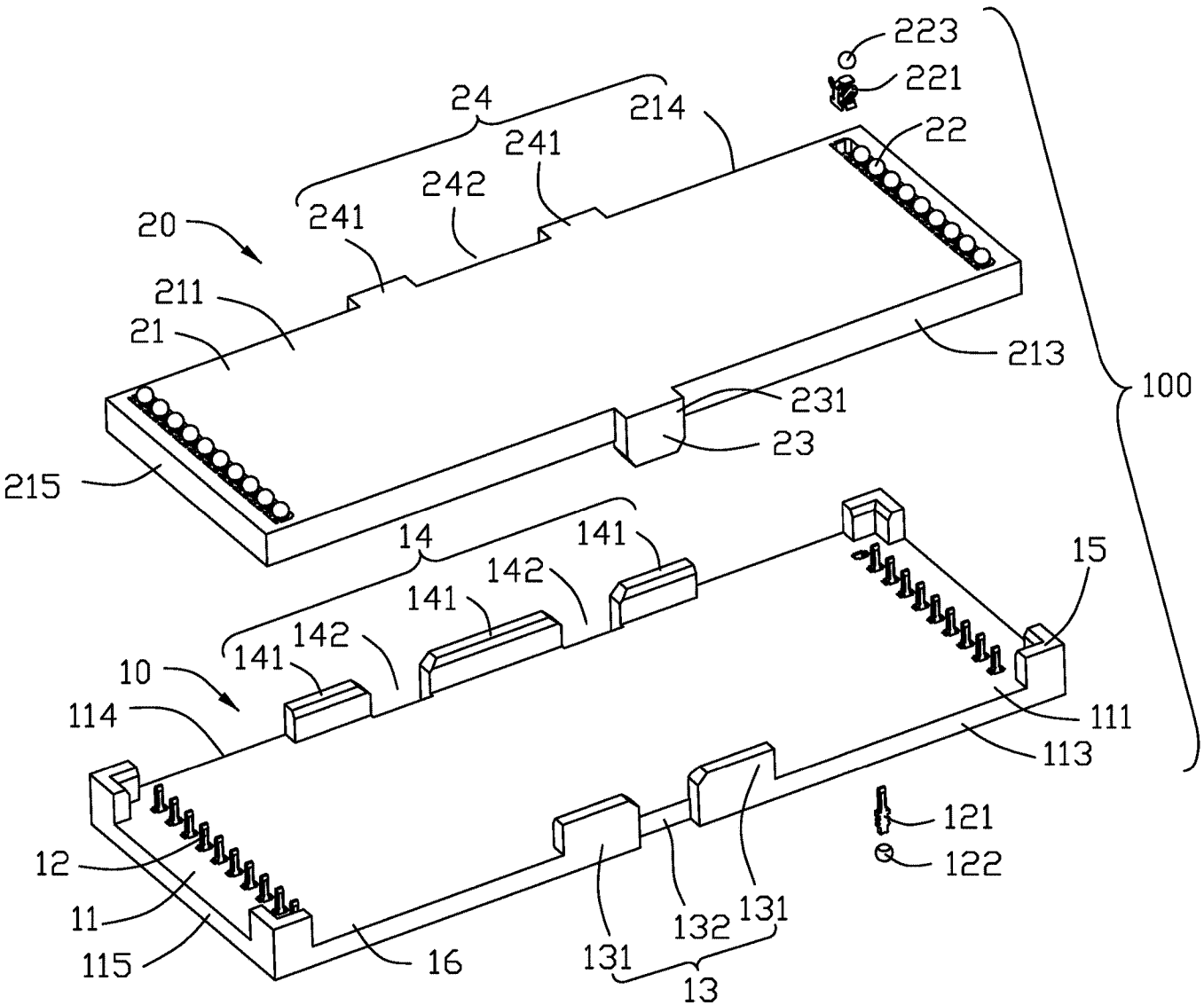
FIG. 4 is an exploded perspective view of the electrical connector assembly of FIG. 1.
Figure 5:
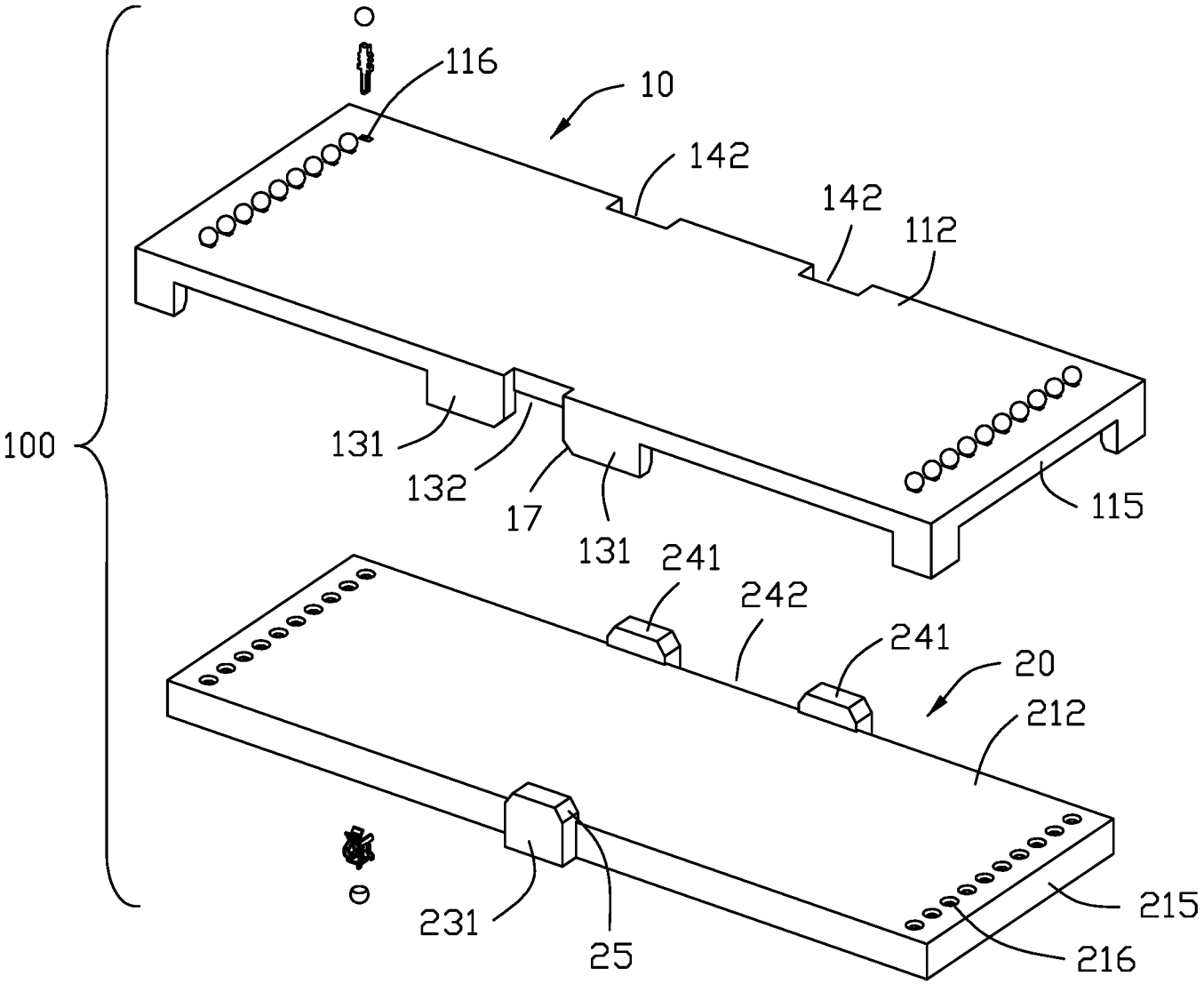
FIG. 5 is another exploded perspective view of the electrical connector assembly of FIG. 4.
Figure 6:
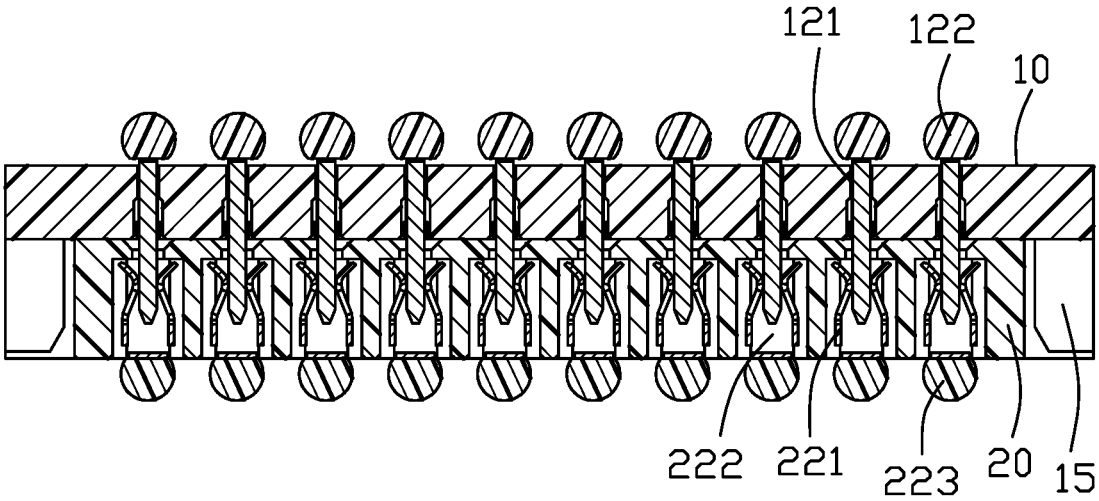
FIG. 6 is a cross-sectional view of the electrical connector assembly of FIG. 1.

Referring to FIGS. 1-8, an electrical connector assembly 100 includes a first/plug/male connector 10 and the second/receptacle/female connector 20 mateable with each other.

The first connector 10 includes an insulative first plate 11 and a plurality of first/plug/male contacts 11 retained thereto. The first plate 11 forms opposite upper and lower surfaces 111, 112, opposite first long side 113 and second long side 114, and a pair of short sides 115. A plurality of passageways 116 extend through both the upper and lower surfaces 111 and 112 to receive the corresponding first contacts 12, respectively. The first long side 113 forms a first alignment structure 13, and the second long side 114 forms a second alignment structure 14 which is offset from the first alignment structure in the longitudinal direction.

The first alignment structure 13 includes two spaced first alignment posts 131 and a first alignment groove 132 therebetween. The second alignment structure 14 includes three second alignment posts 141 spaced from one another with two corresponding second alignment grooves 142 therebetween. Each of the posts 131 and 141 is upstanding, i.e., extending upward beyond the upper surface 111 of the first plate 11.

Four L-shaped posts 15 are located at four corners of the first plate 11 so as to cooperate with the first alignment structure 13 and the second alignment structure 14 for defining a receiving space 16.

The first contact 12 includes a first mating section 121 and the first solder ball 122 attached thereto, which is exposed upon the lower surface 112.

The second connector 20 includes an insulative second plate 21 and a plurality of second contacts 22 retained thereto. The second connector 20 is received within the receiving space 16 during mating. The second plate 21 includes a third alignment structure 23 coupled/engaged with the first alignment structure 13, and a fourth alignment structure 24 coupled/engaged with the second alignment structure 24. Notably, the height of the L-shaped post 15, and those of the first alignment post 131 and the second alignment post 141 are essentially same with the thickness of the second connector 20 so as to have the mated first connector 10 and second connector 20 keep the flat configuration on two opposite mounting sides.

Similar to the first connector 10, the second plate 21 of the second connector 20 includes opposite upper surface 212 and lower surface 211, opposite third long side 213 and fourth long side 214, and opposite two short sides 215 wherein the plurality of second passageways 216 extend through both the upper surface 211 and the lower surface 212. A plurality of second contacts 22 are received within the corresponding passageways 216

The third alignment structure 23 includes a third alignment post 231 extending from the third long side 213, and the fourth alignment structure 24 includes two fourth alignment posts 241 spaced from each other with an alignment slot 242 therebetween in the longitudinal direction and extending from the fourth long side 214. Similarly, the third alignment post 23, as well as the four alignment post 24, extends above the second plate 21 with a height essentially same with the thickness of the first connector 10 for keeping the flat configuration on two opposite mounting sides of the mated first connector 10 and second connector 20. Notably, during mating, the third alignment post 231 is received within the first alignment groove 132, and the fourth alignment posts 241 are received within the corresponding second alignment grooves 142, respectively. The middle second alignment post 141 is received within the alignment slot 242 as well.

The second contact 22 includes a second mating section 221 with a mating space 222 therein, and a second solder ball 223 attached to the second mating section 221 and exposed upon the lower surface 211. The first mating section 121 is inserted into the mating space 222.

Understandably, for easy mating, chamfers 25 are formed on the corresponding third alignment post 231 and fourth alignment post 241, and chamfers 17 are formed on the corresponding first alignment post 131 and second alignment post 141 as well. Moreover, the first contacts 12 extend beyond the upper surface 111 of the first plate 11 while the second contacts 22 are fully hidden behind the upper surface 212 of the second plate 21 so that during mating the upper surface 111 of the first connector 10 and the upper surface 212 of the second connector 20 intimately contact each other with therebetween an interface of which most of outside edge portions are essentially exposed sideward to an exterior.

Figure 7:
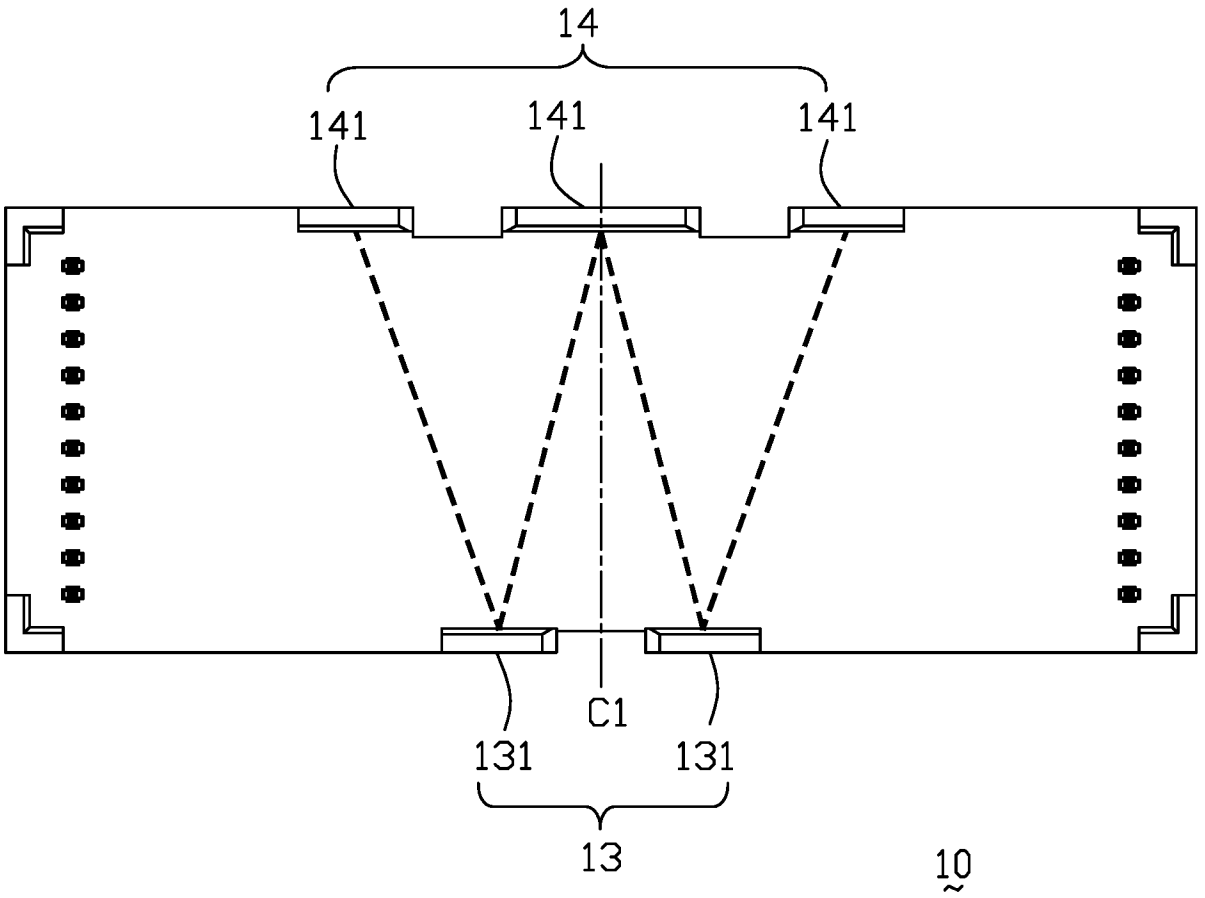
FIG. 7 is a plan view of the male connector of the electrical connector assembly of FIG. 1.
Figure 8:
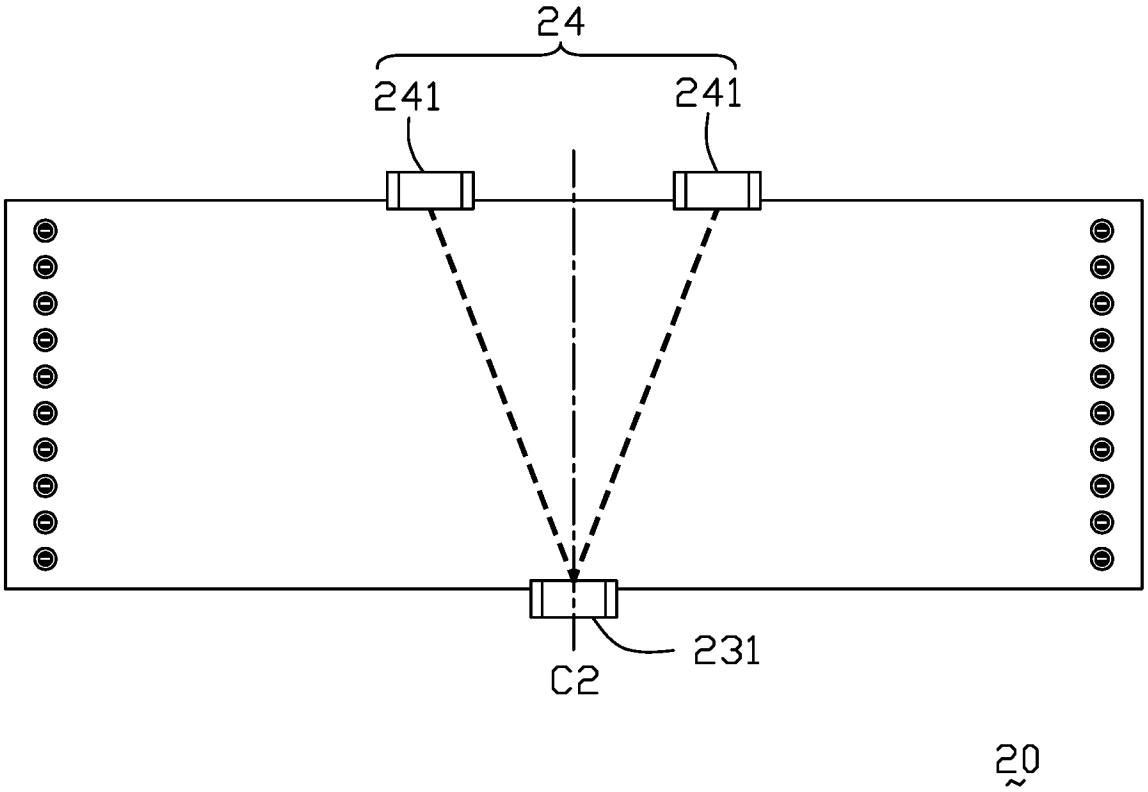
FIG. 8 is a plan view of the female connector of the electrical connector assembly of FIG. 1.

As shown in FIGS. 7 and 8, in a plan view, in the first connector 10 the two first alignment posts 131 of the first alignment structure 13 and the three second alignment posts 141 of the second alignment structure 14 commonly form a "W" like arrangement wherein the two first alignment posts 131, as well as the three second alignment posts 141, are symmetrical with regard to the transverse centerline C1 of the first connector 10 in the longitudinal direction. Similarly, in a plane view, in the second connector 20 there third alignment post 231 of the third alignment structure 23 and the two four alignment posts 241 of the fourth alignment structure 24 commonly form a "V" like arrangement wherein the third alignment post 231, as well as the two fourth alignment posts 241, are symmetrical with regard to the transverse centerline C2 of the second connector 20. Understandably, the symmetrical arrangement along the longitudinal direction of the housing of the connector may benefit structure forming and the strength thereof.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

a first connector including:

an insulative first plate defining opposite upper and lower surfaces in a vertical direction, opposite long sides in a transverse direction perpendicular to the vertical direction, and opposite short sides in a longitudinal direction perpendicular to both the vertical direction and the transverse direction;

a plurality of passageways extending through both the upper surface and the lower surface;

a plurality of first contacts disposed in the corresponding passageways, respectively; and an upstanding first alignment structure formed on one of the long sides, and an upstanding second alignment structure formed on the other of the long sides; wherein the first alignment structure is symmetrical with regard to a transverse centerline of the first connector in the longitudinal direction, the second alignment structure is symmetrical with regard to the transverse centerline of the first connector in the longitudinal direction, while the first alignment structure and the second alignment structure are offset from each other along the longitudinal direction in a side view taken along the transverse direction; and a second connector configured to be mateable with the first connector, wherein the second connector includes an insulative second plate defining opposite top and bottom surfaces thereof and retaining a plurality of second contacts therein, a third alignment structure coupled with the first alignment structure and a fourth alignment structure coupled with the second alignment structure during mating, wherein the third alignment structure, as well as the fourth alignment structure, is symmetrical with regard to a transverse centerline of the second connector in the longitudinal direction while the third alignment structure and the fourth alignment structure are offset from each other along the longitudinal direction in the side view taken along the transverse direction; wherein the first alignment structure includes at least one first alignment post with thereof a free end substantially reaching and exposed upon the bottom surface of the second plate of the second connector when the first and second connectors are mated, the second alignment structure includes at least one second alignment post with thereof a free end substantially reaching and exposed upon the bottom surface of the second plate of the second connector when the first and second connectors are mated, and the third alignment structure includes at least one third alignment post with thereof a free end substantially reaching and exposed upon the lower surface of the first plate of the first connector when the first and second connectors are mated, and the fourth alignment structure includes at least one fourth alignment post with thereof a free end substantially reaching and exposed upon the lower surface of the first plate of the first connector when the first and second connectors are mated.

2. The electrical connector assembly as claimed in claim 1, wherein each of the first alignment structure and the second alignment structure includes at least one alignment post, and an amount of the alignment posts of the first alignment structure is different from that of the second alignment structure.

3. The electrical connector assembly as claimed in claim 2, further including four L-shaped posts on four corners of the first plate, wherein the four L-shaped posts cooperate with the alignment posts of the first alignment structure and the second alignment structure to commonly form a receiving space for receiving a second connector.

4. The electrical connector assembly as claimed in claim 1, wherein each of the third alignment structure and the fourth alignment structure includes at least one alignment post, and an amount of the alignment posts of the third alignment structure is different from that of the fourth alignment structure.

5. The electrical connector assembly as claimed in claim 4, wherein the alignment posts extend beyond an upper surface of the second plate with a height essentially the same as a thickness of the first plate in the vertical direction.

6. The electrical connector assembly as claimed in claim 1, wherein each of the first alignment structure and the second alignment structure includes at least one alignment post, and an amount of the alignment posts of the first alignment structure is different from that of the second alignment structure, wherein the alignment posts of either the first alignment structure or the second alignment structure extend beyond the upper surface of the first plate with a height essentially the same as a thickness of the second plate of the second connector in the vertical direction.

7. The electrical connector assembly as claimed in claim 1, wherein the first contacts extend beyond the upper surface of the first plate while the second contacts are fully hidden behind the top surface of the second plate; during mating, the upper surface of the first connector and the top surface of the second connector intimately contact each other with therebetween an interface, of which most of outside edge portions are essentially exposed sidewardly to an exterior.

* * * * *